US006398388B1

(12) United States Patent
Lorenzana et al.

(10) Patent No.: US 6,398,388 B1
(45) Date of Patent: Jun. 4, 2002

(54) WINDOW MOUNTED ILLUMINATED ORNAMENT

(76) Inventors: Moises B. Lorenzana, 601 Lake Hinsdale Dr., Willowbrook, IL (US) 60514; Vance A. Lorenzana, 73 Chippewa Dr., Oswego, IL (US) 60543

( * ) Notice: Subject to any disclaimer, the term of this patent is extended or adjusted under 35 U.S.C. 154(b) by 0 days.

(21) Appl. No.: 09/609,799

(22) Filed: Jul. 3, 2000

(51) Int. Cl.[7] ..... F21V 21/00

(52) U.S. Cl. ..... 362/240; 362/249; 362/806

(58) Field of Search ..... 362/122, 123, 362/124, 226, 231, 240, 246, 249, 252, 396, 805, 806, 808, 486, 503, 540, 544

(56) References Cited

U.S. PATENT DOCUMENTS

| | | | | | |
|---|---|---|---|---|---|
| 2,849,601 | A | * | 8/1958 | Walzer | 362/808 |
| 4,537,806 | A | | 8/1985 | Sherrard | 428/7 |
| 4,860,476 | A | | 8/1989 | Hall | 40/593 |
| 4,937,107 | A | * | 6/1990 | Mirisch, Sr. | 362/123 |
| 5,016,145 | A | | 5/1991 | Sindleton | 362/80.1 |
| 5,315,492 | A | | 5/1994 | Davenport | 362/123 |
| 5,396,408 | A | | 3/1995 | Szezech | 362/397 |
| 5,477,437 | A | * | 12/1995 | Lach | 362/252 |
| 5,803,577 | A | | 9/1998 | Stratton | 362/80 |
| 5,815,969 | A | | 10/1998 | Brouwer | 40/574 |
| 5,820,251 | A | | 10/1998 | Greenberg et al. | 362/227 |
| 5,993,025 | A | | 11/1999 | Huang | 362/249 |

* cited by examiner

*Primary Examiner*—Y. My Quach-Lee
(74) *Attorney, Agent, or Firm*—Neil M. Rose

(57) ABSTRACT

An illuminated ornament simulating a Christmas tree having a plastic housing with one set of lights mounted within the housing to illuminate the outline of the tree and a second set of colored lights mounted for direct viewing outside of the housing.

15 Claims, 2 Drawing Sheets

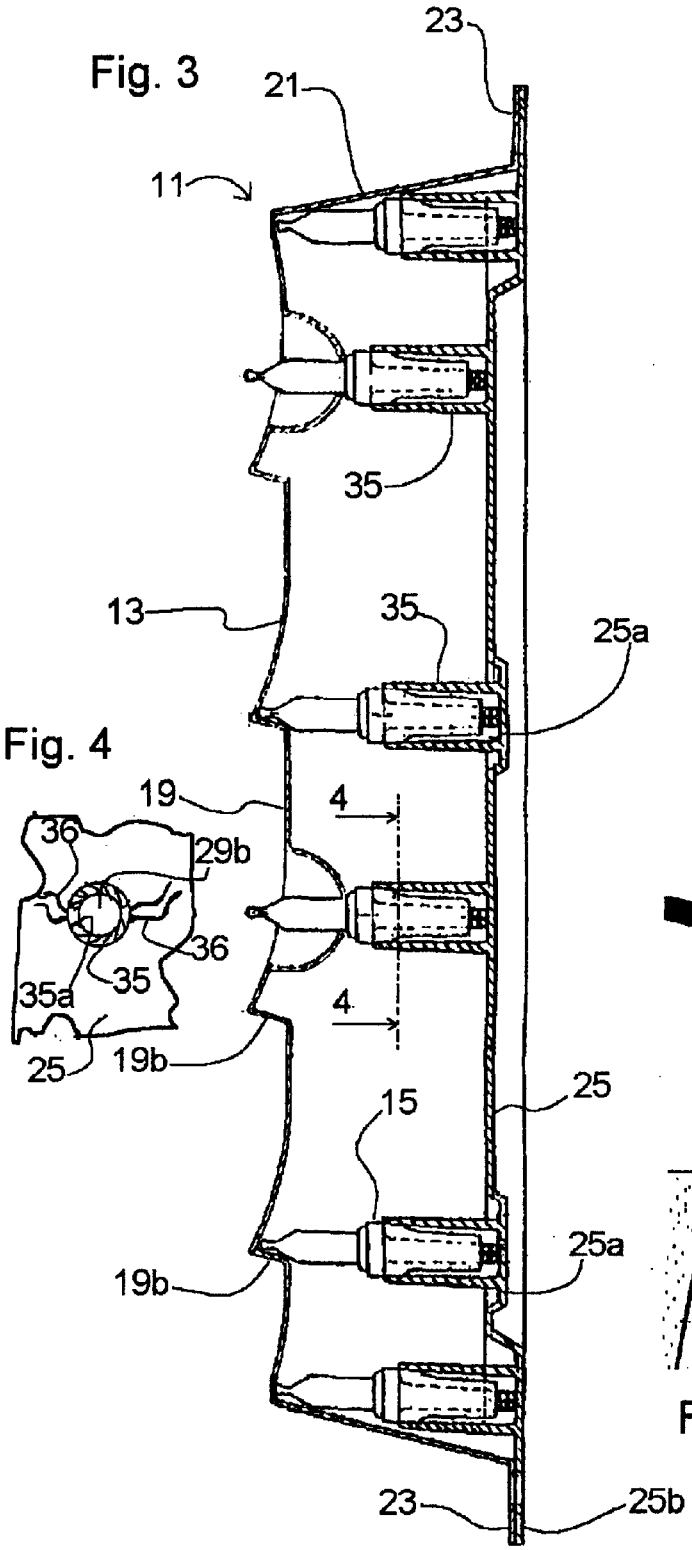
Fig. 3
23
21
11
35
13
35
25a
19
4
4
25
15
25a
19b
23
25b
Fig. 4
36
29b
36
35a
35
25
19b
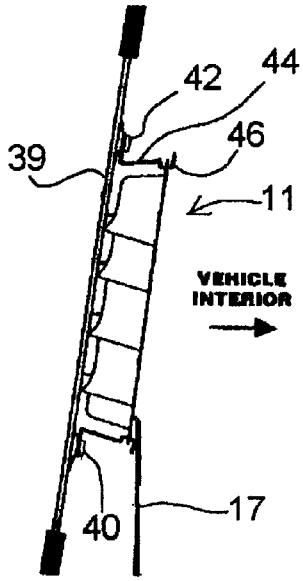
42
44
46
39
11
VEHICLE INTERIOR
40
17
Fig. 5
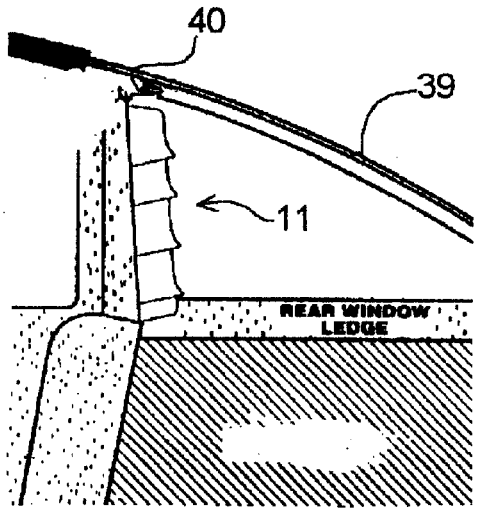
40
39
11
REAR WINDOW LEDGE
Fig. 6

WINDOW MOUNTED ILLUMINATED ORNAMENT

BACKGROUND OF THE INVENTION

1. Field of the Invention

The present invention relates generally to the field of illuminated ornaments and, specifically to hollow ornaments provided with various sets of lights one set being concealed to illuminate the ornament internally and another set exposed so as to be visible externally of the ornament.

It is well known to provide seasonal decorations for the home or the automobile. Particularly during the Christmas season or Halloween period, it is common to decorate homes and cars with ornaments which comprise simulated wreaths, candles, Christmas trees and jack-o-lanterns. It is common to illuminate these ornaments by means of external floodlights or illumination means mounted directly on or in the ornament itself. Often these ornaments are substantially two dimensional so as to adapt them to being mounted on a window for viewing from the side of the window opposite to the side on which the ornament is mounted. By "substantially two dimensional" it is intended to indicate that such ornaments have little depth, no more than 2 or 3 inches so as to lie fairly flat against the window. One of the goals in the design of such ornaments is to illuminate them in a way that gives the ornament a realistic, three dimensional appearance.

This objective is difficult to achieve with ornaments that are simulated Christmas trees. It is desirable to have the outline and the limbs of the green tree lighted and visible and, at the same time, have the colored tree lights normally associated with the decoration of such trees also visible.

2. Description of the Prior Art

The concept of having illuminated signs or ornaments adapted for automobile mounting with power connection to the cigarette lighter attachment of the automobile is known and is illustrated in the patents to Singleton U.S. Pat. No. 5,016.145, to Stratton U.S. Pat. No. 5,803,577, to Brouwer U.S. Pat. No. 5,815,969 and to Hall U.S. Pat. No. 4,860.476. All of the foregoing patents include some type of enclosure for the lighting bulb or bulbs, a power cord with a plug connector and suction cups, adhesive or clip means to secure the device to a window or the body of the automobile. Patents directed to illuminated holiday ornaments for home decoration include Greenberg et al U.S. Pat. No. 5,820,251, Davenport U.S. Pat. No. 5,315,492 and Szczech U.S. Pat. No. 5,396,408. The ornament of the Greenberg patent is a two dimensional representation of a candelabra with light bulbs extending through the two dimensional representation to illuminate the candle and the illustration of the candle flame. The Davenport patent discloses various types of illuminated ornaments including wreaths and candles being battery operated and having suction cups for mounting on a window. The Szczech patent is directed to a suction cup mounted illuminated ornament which is adapted for mounting either on a window facing outwardly through the window or on a wall facing away from the wall.

There are several examples in the prior art of two dimensional illuminated Christmas trees. These include the Huang U.S. Pat. No. 5,993,025 and Sherrard U.S. Pat. No. 4,537, 806. Both of these patents disclose a flat illustration of a Christmas tree with holes or grooves provided to receive bulbs which illuminate the two dimensional representation.

SUMMARY OF THE INVENTION

The present invention is directed to an illuminated ornament which includes a housing in the form of a representation of a Christmas tree formed of a green translucent material. The housing has substantially flat parallel front and back walls spaced only a few inches apart which adapt it for surface mounting on a vertical window in a car, van or home. The front and back walls are connected by a continuous sidewall with the front and sidewalls contoured to have simulated branches and boughs to create a representation of a Christmas or fir tree To illuminate the ornament a string of small incandescent light bulbs is mounted in the housing. The string is divided into two distinct sets of bulbs, one being clear and the other being colored. The clear set of bulbs serves to illuminate the tree itself including its outline and the transversely extending rows of bough representations. The clear set of bulbs is mounted within the housing enclosure so that the bulbs cause the housing to provide a green glow in the shape of the Christmas tree. The colored lights are mounted extending through the front wall of the housing so as to be directly visible from in front of the ornament. The portion of the front wall surrounding each of the colored bulbs is formed with a hemispherical depression which serves as a reflector with respect to the light radiating from each of the colored bulbs.

The mounting of the string of bulbs within the housing is accomplished with no clips or fixtures by providing forwardly facing pockets or recesses in the back wall to receive the bases of the bulbs. The bulbs are positioned in these pockets with the outer portions of the bulbs remote from the bases being engaged against the front wall to retain them in fixed position in the housing. The pockets in the back wall which receive the bases of the bulbs are formed by cylindrical walls molded integrally with the back wall. These cylindrical walls have oppositely disposed slots to allow clearance for the electrical wires connected to the base of each of the bulbs.

The front and back walls of the ornament are secured together by overlapping peripheral wall portions on the back wall and the sidewall which are ultrasonically welded together. These overlapping wall portions are formed with upper and lower apertures to receive support hooks connected to suction cups conventionally used for window mounting of decorative ornaments.

Accordingly, it is an object of the present invention to provide an improved illuminated window mounted ornament in the form of a representation of a Christmas tree.

It is a further object of the present invention to provide an improved illuminated ornament having two sets of lights, one to illuminate the overall shape of the ornament and the other to illuminate colored spots on the ornament.

It is another object of the present invention to provide an illuminated ornament having the form of a representation of a Christmas tree with a translucent green housing illuminated from within by one set of lights and having a second set of lights extending outside of the housing to be observed directly.

It is still another object of the invention to provide an improved illuminated ornament having two sets of lights for lighting the ornament internally and externally with the lights being mounted by clamping them between parallel front and back walls of a light bulb enclosure.

Additional objects and advantages of the invention will become apparent as the following detailed description of the preferred embodiment is read in conjunction with the accompanying drawings which illustrate such preferred embodiment.

BRIEF DESCRIPTION OF THE DRAWINGS

While the present invention is described with particularity in the claims annexed to and forming a part of this specification, a better understanding of the invention can be had by reference to the following description taken in conjunction with the accompanying drawings in which:

FIG. 3 is a sectional view taken on line 3—3 of FIG. 1;

FIG. 4 is a fragmentary sectional view of one of the bulb mounting pockets taken on line 4—4 of FIG. 3 assuming that FIG. 3 showed the complete mounting pocket;

FIG. 5 is a schematic showing of the ornament of the present invention mounted on the interior of a car window; and FIG. 6 is a schematic showing similar to FIG. 5 but with the ornament mounted on a sloping rear window of a car.

DETAILED DESCRIPTION OF THE PREFERRED EMBODIMENT

Figure 1:
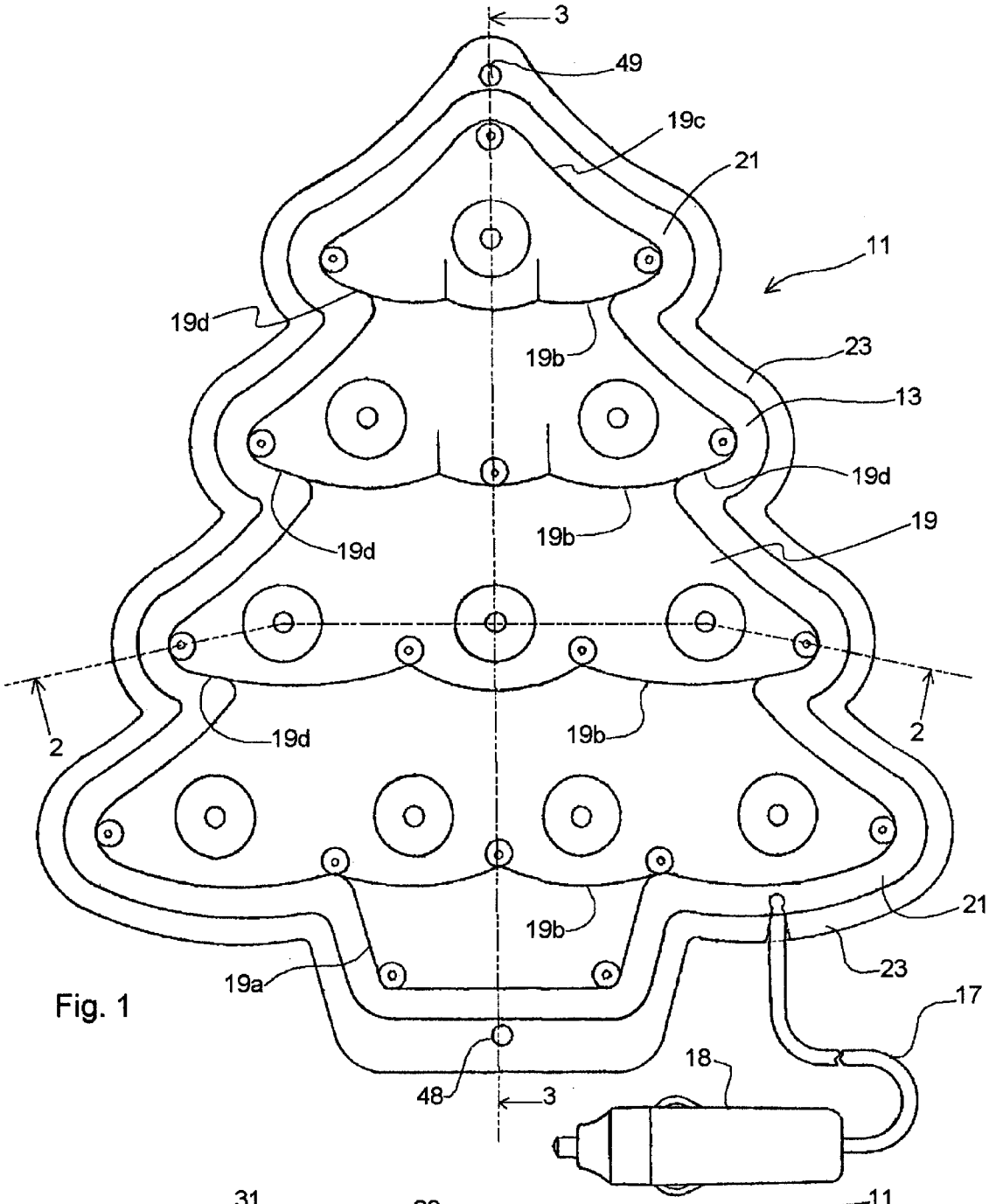
FIG. 1 is a front elevational view of an illuminated ornament embodying our invention.

As shown in FIG. 1 of the drawings of the preferred embodiment, the ornament of the present invention is in the form of a Christmas tree designated generally by reference numeral 11. The ornament 11 is made up of a housing 13 which supports and encloses a light set 15 having a power cord 17 which extends outside of the housing 13 and supplies power from an automobile battery source by means of a plug connector 18. The housing 13 is formed of plastic material either a vinyl or styrene to provide a wall thickness of 0.010 inches to 0.025 inches. To obtain a green translucent housing, the neutral plastic material is modified by adding 4% to 5% green colorent to the neutral plastic. For reasons to be explained in detail below, the front part of the housing is vacuum formed and the back part is injection molded. With the proper wall thickness and coloring, the housing may be caused to glow with a green color when illuminated from within.

The housing 13 is formed by a front wall 19 having the shape or outline of a representation of a Christmas tree with a base projection 19*a*, transversely extending overhangs 19*b* representing the boughs of the tree and a tapering top 19*c* at the summit of the tree. At both ends of each of the overhangs 19*b*, the front wall 19 is formed with scalloped portions 19*d* to simulate the appearance of sidewardly extending boughs. Extending rearwardly from around the periphery of the front wall 19 is a continuous sidewall 21 which terminates in a flange portion 23. The front wall 19 as well as the continuous sidewall 21 and the flange portion 23 are vacuum formed in one piece. In one constructed embodiment of the invention, the plastic stock used in the vacuum forming was 0.025 inches thick initially. However, the forming process causes the material to become thinner along the juncture of the front wall 19 and the sidewall 21. The forming process also results in a thinner wall along the edge defining the front of the transversely extending overhangs 19*b*. As a consequence of the forming process, the front wall has a thickness of on the order of 0.008 inches around the periphery and along the front edges of the overhang 19*b*. In the areas of the front wall between the thin comer edges, the wall thickness in the constructed embodiment was on the order of 0.022 inches while the side wall 23 had a thickness of 0.015 inches.

Figure 2:
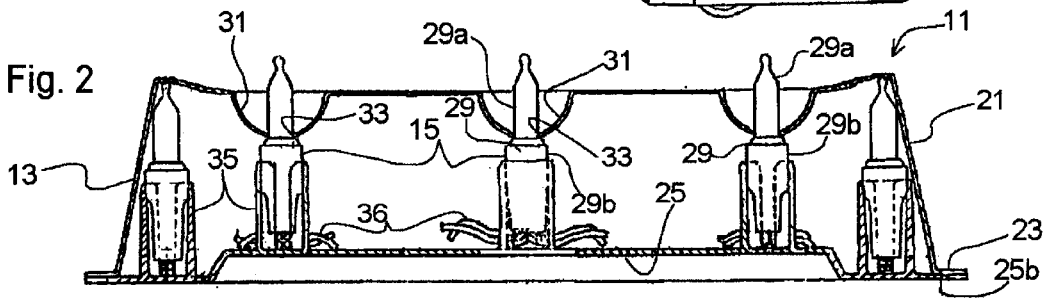
FIG. 2 is a sectional view taken on line 2—2 of FIG. 1.

To complete the housing 13, there is provided a back wall 25 which is parallel to and spaced rearwardly from the front wall 19 as is best shown in FIGS. 2 and 3. The back wall 25 includes rearwardly displaced pockets 25*a* and terminates in a rim 25*b* coextensive and engaged with the flange portion 23 associated with the sidewall 21. To complete the assembly of the housing 13, the flange portion 23 and rim 25*b* are ultrasonically welded together at spaced points to provide the enclosure for the light set 15. The flange portion 23 and rim 25*b* could alternatively be secured together by chemical bonding or other known methods.

The light set 15 includes 27 standard miniature Christmas tree lights 29 connected in parallel to the power cord 17. Each of the lights 29 has an elongated glass bulb 29*a* extending from and mounted in a base 29*b*. For the purpose to be explained below, the light set 15 is wired to have a first group of clear glass bulbs and a second group of colored bulbs. The colored bulbs are mounted to project outside of the housing 13 while the clear glass bulbs are enclosed within the housing 13.

To enhance the light radiated from the colored bulbs, the front wall 19 of the housing 13 is formed with reflecting pockets 31 as shown in FIG. 2. The pockets 31 are hemispherical in shape with holes or openings 33 formed at the bottom of each pocket to receive one of the colored bulbs 29*a*. The holes 33 provide a snug fit for the bulbs, and the base 29*b* of each of the lights abuts against the portion of each pocket 31 facing toward the back wall 25. For the purpose of fixedly positioning the base of each of the lights 29, the back wall is formed with forwardly projecting cylindrical walls 35 which are of a size and shape to snugly engage the bulb bases 29*b*. Associated with each of the lights 29 are the wires 36 which extend to and from each of the bases 29*b* to accomplish the parallel connection of the lights to the power cord 17. Each of the cylindrical walls 35 is provided with oppositely disposed slots 35*a* which extend from the back wall 25 to the forward end of each of the walls 35 to allow the wires 36 to extend into the bottom of the pockets formed by the walls 35 and the wall 25 for connection to the bases 29*b*. The lights 29 having colored bulbs are retained in the pockets formed by the walls 35 and 25 by the portions of the front wall 19 defining the pockets 31.

The lights 29 having the clear glass bulbs are also mounted and secured in place between the front wall 19 and the back wall 25 by the clamping action of these walls. The lights 29 with the clear glass bulbs have their bases 29*b* received in and supported by the cylindrical walls 35 as described above. As is evident from FIG. 3, the pockets defined by the cylindrical walls 35 and back wall 25 vary in their spacing from the front wall so that the tips of the clear glass bulbs 29*a* will engage the inner surface of the front wall 19. Thus the lights positioned behind the base projection 19*a* and the top 19*c* are held by cylindrical walls 35 extending from portions of the rear wall 25 adjacent the rim 25*b*. As a consequence, the lights behind the base projection 19*a* and the top 19*c* spaced slightly rearwardly of the lights engaged with the bough portions 19*b*. In all instances, the light mounting pockets are positioned so that the lights 29 are clamped between the front and back walls.

The purpose of the lights 29 having the clear glass bulbs positioned within the housing 13 is to cause the green translucent walls of the housing to glow so that the representation of the Christmas tree will be visible in the dark. In contrast, the colored lights in the set are exposed outside of the housing so that they may be viewed directly. The reflecting walls 31 create a halo effect around each of the colored bulbs making the bulbs appear larger than they actually are and thereby enhancing the visibility of the colored bulbs. Thus when the ornament 11 is mounted in the window of a car at night and connected to the cigarette lighter through the power cord 17, the clear bulbs cause the Christmas tree shaped housing 13 to glow with a green cast, and the colored bulbs are visible directly presenting the appearance of a Christmas tree decorated by a string of colored lights.

It has been determined that the visibility of the outline of the Christmas tree and the boughs of the tree is enhanced when the edges of the front wall 19 and the boughs 19*b* are provided with reduced thickness plastic in those limited areas through the use of the vacuum forming process. With the plastic reduced in thickness from 0.025 inches to 0.008 inches in these areas, the outline of the tree and the boughs becomes more distinguishable and visible in spite of the glow of the colored lights.

For the purpose of mounting the ornament 11 on the inside of a car window 39, there is provided a pair of suction cup supports 40 which are shown in FIG. 5. Each of the supports 40 includes a suction cup 42 and a wire form bracket 44. A hook 46 on the outer end of each bracket designed to engage in mounting holes 48 and 49 located at the top and bottom of the ornament 11 as best shown in FIG. 1. The lower of the supports 40 as shown in FIG. 5 has the hook 46 directed downwardly in the opposite direction from the upper support so that the ornament 11 is suspended between the two hooks 46. With the supports 40 mounted on the inside of the car window and the hooks 46 engaged with the holes 48 and 49, the ornament 11 is positioned immediately against the inside of the window 39 facing outwardly so that it is easily visible.

The use of the suction cup support at the top and bottom of the ornament 11 has been found to be necessary to prevent swaying of the ornament as a consequence of the forces produced by the car's changes in speed or direction during operation. As shown in FIG. 5, the suction cup brackets 40 connected to the top and bottom of the ornament 11 mount the ornament in a generally vertical position against the interior surface of the vehicle window 39. However, in installations in which the rear window has a substantial slope or inclination an alternative approach must be followed. In installation of the ornament on sloping rear windows, a single top mounting support 40 may be used as shown in FIG. 6 with the bottom of the ornament 11 engaged with the deck area of the car behind the car seat to prevent swaying.

The reduced thickness of the front housing along the periphery and the edges of the representations of the boughs could be achieved by machining or molding techniques other than vacuum molding. Thus it is intended that the present invention cover the modifications and variations of this invention, provided they come within the scope of the appended claims and their legally permissible equivalents.

What is claimed is:

1. An illuminated ornament for mounting on the window of an automobile comprising:

a. a plastic housing formed of a translucent light diffusing material including front and rear housing members joined together to form an enclosure for a set of electric lights, the front housing member being a substantially planar representation of a fir tree with a front wall surrounded by a peripheral wall forming a cavity within which the set of lights is mounted, the rear housing member being coextensive with the front housing member and joined to said peripheral wall to close the cavity forming the enclosure, b. the set of lights includes a plurality of clear light bulbs and a plurality of multicolored light bulbs interconnected by a wiring harness that terminates in a power cord extending outside of the housing enclosure to a plug powering the set of electric lights from an automobile battery source, c. the housing being formed with a first set of bulb mounting means disposed around the periphery of said housing to mount the clear light bulbs within the enclosure so that the entirety of the housing is illuminated, d. the housing being formed with a second set of bulb mounting means disposed across said front wall to mount the multicolored light bulbs extending through the front housing member to a position outside of the enclosure.

2. The illuminated ornament of claim 1 wherein each said light bulb comprises a glass bulb having a base at one end to which said wiring harness is connected, said rear housing member being formed with forwardly facing pockets in which said bulb bases are received, each of said lights being fixedly secured in one of said pockets by engagement with said front wall.

3. The illuminated ornament of claim 1 wherein each said multicolored light bulb comprises a glass bulb having a base at one end to which said wiring harness is connected and an other end extending away from said base, said mounting means for said multicolored bulbs including hemispherical depressions formed in said front wall with one aperture in each depression to receive a glass envelope of a multicolored bulb, said multicolored bulbs extending outside of said enclosure to direct light outwardly from said ornament.

4. The illuminated ornament of claim 3 wherein the depressions in said front wall defining said apertures engage said glass envelopes adjacent said bases to retain said multicolored bulbs in fixed position, the bases of said multicolored bulbs being held against said front wall by forward pressure exerted by said rear housing member.

5. The illuminated ornament of claim 4 wherein said rear housing member is formed with forwardly facing pockets in which said bulb bases are received, each of said lights being fixedly secured in one of said pockets by engagement with said front wall.

6. The illuminated ornament of claim 1 including bracket supports secured to opposite edges of said housing to mount said ornament with said representation of a fir tree in an upright position in the window of an automobile, said bracket supports including suction cups to attach the bracket supports to an inside surface of the window.

7. An illuminated ornament for mounting on one side of a window for viewing from the other side comprising a. a plastic housing formed of a translucent light diffusing material including front and rear housing members joined together to form an enclosure for a set of electric lights, the front housing member being a substantially planar representation of a fir tree with a front wall surrounded by a peripheral wall forming a cavity within which the set of lights is mounted, the rear housing member being parallel to and coextensive with the front housing member and joined to said peripheral wall to close the cavity forming the enclosure, b. a set of electric lights comprising a string of lights having glass bulbs supported on bases connected in parallel by wires joined to a power cord, said lights being mounted in said enclosure and having a plurality of colored light bulbs and a plurality of clear glass bulbs, c. said rear housing member having pockets in which said bulb bases are received with said bulbs projecting toward said front housing member, said colored bulbs extending through openings in said front housing member to be visible from outside of said enclosure, said clear glass bulbs being positioned completely within said enclosure adjacent to said peripheral wall to illuminate the outline of said fir tree representation.

8. The illuminated ornament of claim 7 wherein said front housing member is formed with scalloped side edges which angle inwardly toward a top point of said housing member and transversely extending overhanging portions to simulate the appearance of the boughs of a fir tree, said lights having the clear glass bulbs being positioned to illuminate said scalloped side edges-and said overhanging portions from the inside of said enclosure, said colored bulbs being spaced from said peripheral walls and spaced from said clear glass bulbs.

9. The illuminated ornament of claim 8 wherein said front housing member is formed with a plurality of hemispherical depressions in each of which is disposed one of the openings through which one of said colored bulbs extends, said depressions being reflectors to project light from said colored bulbs outwardly.

10. The illuminated ornament of claim 8 wherein said front housing member is formed with a wall thickness which is reduced along said scalloped edges and said overhanging portions as compared to the wall thickness elsewhere on said front housing member.

11. The illuminated ornament of claim 10 wherein said front housing member is vacuum formed of material on the order of 0.025 inches in thickness, the material being reduced in thickness during forming along the edges of the boughs and the periphery of the front wall to a thickness of on the order of 0.008 inches.

12. An illuminated ornament for mounting on a window comprising: a plastic housing formed of a translucent light diffusing material including front and rear housing members joined together to form an enclosure for a set of electric lights, the set of lights includes a plurality of clear light bulbs and a plurality of multicolored light bulbs interconnected by a wiring harness that terminates in a power cord extending outside of the housing enclosure to a plug powering the set of light from a power source, the housing being formed with a first set of bulb mounting means to mount the clear light bulbs within the enclosure so that entirety of the housing is illuminated, the housing being formed with a second set of bulb mounting means disposed across the housing to mount the multicolored light bulbs extending through the front housing member to a position outside of the enclosure.

13. The illuminated ornament of claim 12 wherein each said clear light bulb and each said multicolored light bulb comprises a glass bulb having a base at one end to which said wiring harness is connected, said rear housing member being formed with pockets facing said front housing member, said pockets receiving said bulb bases, each of said light bulbs being fixedly secured in one of said pockets by engagement with said front housing member.

14. The illuminated ornament of claim 12 wherein each said multicolored light bulb comprises a glass bulb having a base at one end to which said wiring harness is connected and a glass envelope at an other end extending away from said base, said mounting means for said multicolored bulbs including hemispherical depressions formed in said front housing member with one aperture in each depression to receive the glass envelope of a multicolored bulb, said multicolored bulbs extending outside of said enclosure to direct light outwardly from said ornament.

15. The illuminated ornament of claim 14 wherein said front housing member defining said apertures engage said glass envelopes adjacent said bases to retain said multicolored bulbs in fixed position, the bases of said multicolored bulbs being held against said front housing member by forward pressure exerted by said rear housing member.

* * * * *